US005698809A

United States Patent [19]

Holt

[11] Patent Number: 5,698,809

[45] Date of Patent: Dec. 16, 1997

[54] PRIMER REMOVAL TOOL

[76] Inventor: David D. Holt, 607 Newell Ave., Dallas, Tex. 75223

[21] Appl. No.: 611,749

[22] Filed: Mar. 6, 1996

[51] Int. Cl.[6] ..... F42B 33/00; F42B 33/10

[52] U.S. Cl. ..... 86/24; 86/37

[58] Field of Search ..... 86/24, 36, 37

[56] References Cited

U.S. PATENT DOCUMENTS

| | | | |
|---|---|---|---|
| 139,674 | 6/1873 | Holmes . | |
| 257,860 | 5/1882 | Gill . | |
| 294,865 | 3/1884 | Giffard . | |
| 329,135 | 10/1885 | Brown . | |
| 332,767 | 12/1885 | Wheaton . | |
| 387,868 | 8/1888 | Farrow | 86/37 |
| 536,045 | 3/1895 | Ripley . | |
| 689,328 | 12/1901 | Seidell | 86/36 |
| 739,151 | 9/1903 | Chick . | |
| 742,768 | 11/1903 | Wetzig | 86/36 |
| 746,368 | 12/1903 | Olney | 86/37 |
| 835,480 | 11/1906 | Swaysgood | 86/36 |
| 1,269,249 | 6/1918 | Barnes | 86/37 |
| 2,314,115 | 3/1943 | Albree | 86/37 |
| 3,180,204 | 4/1965 | Sampson | 86/37 |
| 3,283,643 | 11/1966 | Mittelsteadt | 86/36 |
| 4,566,366 | 1/1986 | Lee | 86/24 |

*Primary Examiner*—Michael J. Carone
*Assistant Examiner*—Theresa M. Wesson
*Attorney, Agent, or Firm*—Baker & Botts, L.L.P.

[57] ABSTRACT

A primer removal tool (10) includes a receiving member (12) pivotally coupled to a guide rod assembly (14). An actuating member (16) is pivotally coupled to the receiving member (12) and the guide rod assembly (14). A first spring (18) is coupled between the receiving member (12) and the guide rod assembly (14). A second spring (20) is coupled between the guide rod assembly (14) and the actuating member (16). Pressure applied between the receiving member (12) and the actuating member (16) compresses the first spring (18) to allow the guide rod assembly (14) to enter the receiving member (12). Additional pressure compresses the second spring (20) to force the guide rod assembly (14) to move toward a press plate (24) of the receiving member (12). The guide rod assembly (14) forces a shell casing (30) against the press plate (24) to allow a de-priming pin (22) of the guide rod assembly (14) to separate a spent primer (32) from the shell casing (30) through an aperture (26) of the press plate (24).

17 Claims, 1 Drawing Sheet

PRIMER REMOVAL TOOL

TECHNICAL FIELD OF THE INVENTION

The present invention relates in general to bullet and firearm technology and more particularly to a primer removal tool.

BACKGROUND OF THE INVENTION

Many conventional devices used for the removal of spent primer require large mechanical configurations, the use of both hands to perform the de-priming operation, or are unnecessarily time consuming to operate. Therefore, it is desirable to have a tool to remove spent primers which is very compact and easy to use.

SUMMARY OF THE INVENTION

From the foregoing, it may be appreciated that a need has arisen for a primer removal tool that is easy to operate and manipulate. In accordance with the present invention, a primer removal tool is provided that substantially eliminates or reduces disadvantages and problems of conventional devices for removing spent primers from shell casings.

According to an embodiment of the present invention, there is provided a primer removal tool that includes a receiving member having a press plate with an aperture therethrough. A guide rod assembly is pivotally coupled to the receiving member. An actuating member is pivotally coupled to the receiving member and the guide rod assembly is also pivotally coupled to the actuating member. The actuating member positions the guide rod assembly within the receiving member and moves the guide rod assembly toward the press plate of the receiving member to allow spent primers to be ejected through the aperture.

The present invention provides various technical advantages over convention devices for removing spent primers. For example, one technical advantage is to have a simple to use primer removal tool. Another technical advantage is to have a primer removal tool with one hand operation. Other technical advantages are readily apparent to one skilled in the art from the following figures, description, and claims.

BRIEF DESCRIPTION OF THE DRAWINGS

For a more complete understanding of the present invention and the advantages thereof, reference is now made to the following description taken in conjunction with the accompanying drawings, wherein like reference numerals represent like parts, in which.

DETAILED DESCRIPTION OF THE INVENTION

Figure 1:
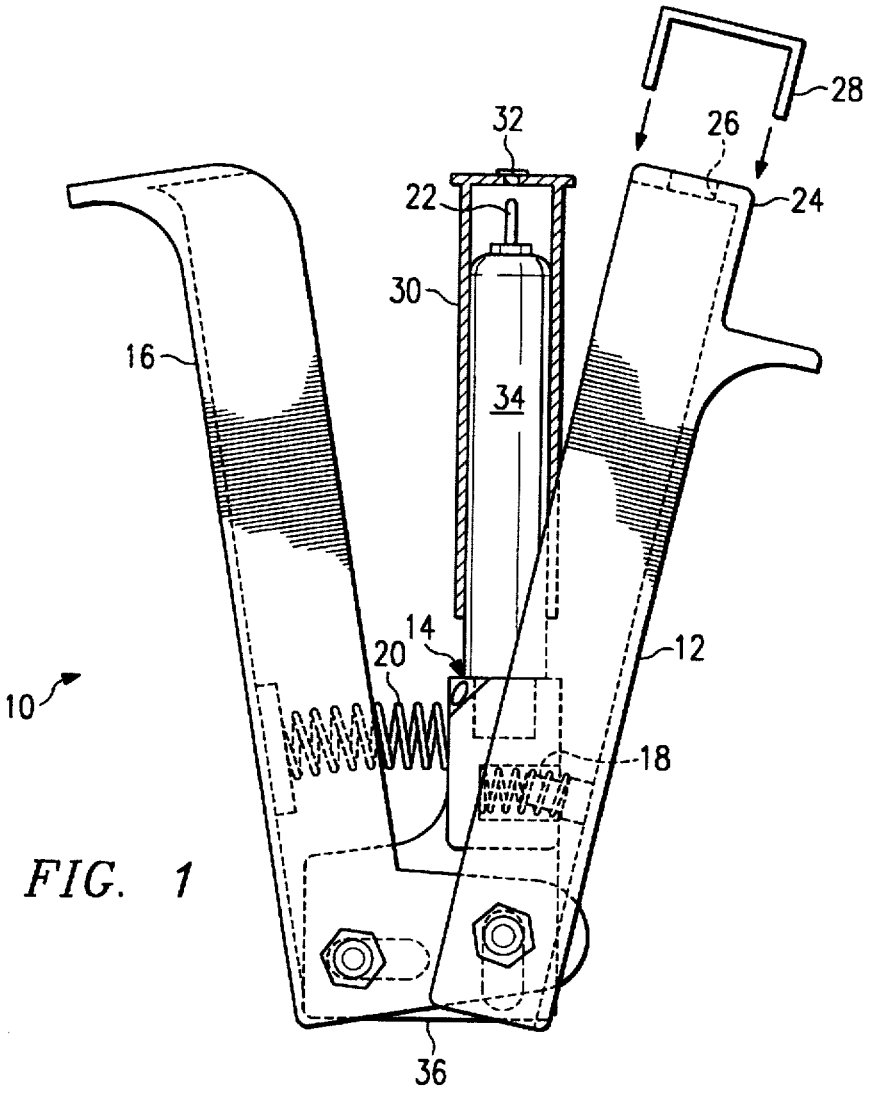
FIG. 1 illustrates a simplified diagram of a primer removal tool.

FIG. 1 is a simplified diagram of a primer removal tool 10. Primer removal tool 10 includes a receiving member 12 pivotally coupled to a guide rod assembly 14. Primer removal tool 10 also includes an actuating member 16 pivotally coupled to guide rod assembly 14. Actuating member 16 is also pivotally coupled to receiving member 12. A first spring 18 is coupled between receiving member 12 and guide rod assembly 14. A second spring 20 is coupled between actuating member 16 and guide rod assembly 14. At one end of guide rod assembly 14 is a de-priming pin 22. At one end of receiving member 12 is a press plate 24 having an aperture 26 therethrough. An optional safety shield 28 may be coupled to receiving member 12 over aperture 26 in press plate 24. Guide rod assembly 14 includes a guide rod element 34 and a base element 36.

In operation, a shell casing 30 having a spent primer 32 is placed over guide rod element 34. Pressure applied from actuating member 16 to receiving member 12 forces guide rod assembly 14 to enter receiving member 12 through compression of first spring 18. Further pressure applied at actuating member 16 compresses second spring 20. The compression of second spring 20 causes guide rod assembly 14 to move toward press plate 24. Guide rod assembly 14 forces shell casing 30 against press plate 24 and de-priming pin 22 forces spent primer 32 through aperture 26 and separation from shell casing 30. Safety shield 28 provides protection from injury in case primer 32 still contains firing capability.

After spent primer 32 has been removed, pressure is removed between actuating member 16 and receiving member 12. The release of pressure causes second spring 20 to decompress and allow guide rod assembly 14 to recede away from press plate 24. First spring 18 decompresses to force guide rod assembly 14 out of receiving member 12 and allow removal of shell casing 30. Primer removal tool 10 is now ready to receive and de-prime the next shell casing.

First spring 18 has a lesser tension than second spring 20 to allow guide rod assembly 14 to enter receiving member 12 before lateral movement occurs toward press plate 24. Though shown as springs, first spring 18 and second spring 20 may be replaced by other forms of resistive elements while still providing the de-priming function for primer removal tool 10. Additionally, first spring 18 and second spring 20 may be removed entirely by using appropriate pivot tensions and/or latching at the pivot couplings of receiving member 12, guide rod assembly 14, and actuating member 16.

Figure 2:
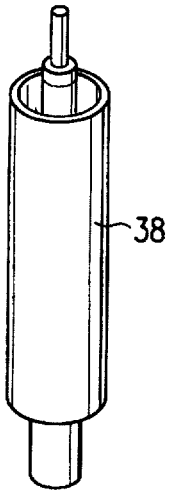
FIG. 2 illustrates a simplified diagram of an alternate guide rod element for the primer removal tool.

Guide rod assembly 14 includes a guide rod element 34 and a base element 36. Base element 36 provides the pivot couplings at receiving member 12 and actuating member 16. Guide rod element 34 is capable of being removed from base element 36 in order to substitute a different guide rod element for de-priming of different size shell casings. Guide rod element 34 is configured to receive shell casing 30 such that shell casing 30 surrounds guide rod element 34. FIG. 2 shows an alternate configuration of guide rod element 34 with a sheath 38 designed to receive and surround shell casing 30.

Thus, it is apparent that there has been provided, in accordance with the present invention, a primer removal tool that satisfies the advantages set forth above. Although the present invention has been described in detail, it should be understood that various changes, substitutions, and alterations readily ascertainable by one skilled in the art can be made herein without departing from the spirit and scope of the present invention as defined by the following claims.

What is claimed is:

1. A primer removal tool, comprising:

a receiving member having a press plate with an aperture therethrough;

a guide rod assembly pivotally coupled to the receiving member; and an actuating member pivotally coupled to the receiving member, the guide rod assembly pivotally coupled to the actuating member, the actuating member operable to position the guide rod assembly within the receiving member, the actuating member operable to laterally move the guide rod assembly within the receiving member toward the press plate.

2. The primer removal tool of claim 1, wherein the guide rod assembly has a guide rod element, the guide rod element including a de-priming pin and a sheath to surround a shell casing.

3. The primer removal tool of claim 2, wherein the guide rod assembly has a base element, the base element being pivotally coupled to the receiving member and the actuating member, the guide rod element being removable from the base element.

4. The primer removal tool of claim 1, wherein the guide rod assembly has a guide rod element, the guide rod element including a de-priming pin and a structure such that a shell casing surrounds the guide rod.

5. The primer removal tool of claim 4, wherein the guide rod assembly has a base element, the base element being pivotally coupled to the receiving member and the actuating member, the guide rod element being removable from the base element.

6. The primer removal tool of claim 1, wherein the guide rod has a de-priming pin operable to extend through the aperture of the press plate in response to the actuating member.

7. A primer removal tool, comprising:

a receiving member having a press plate with an aperture therethrough;

a guide rod assembly pivotally coupled to the receiving member;

an actuating member pivotally coupled to the receiving member, the guide rod assembly pivotally coupled to the actuating member, the actuating member operable to position the guide rod assembly within the receiving member, the actuating member operable to move the guide rod assembly toward the press plate of the receiving member; and a safety shield over the aperture of the press plate.

8. A primer removal tool, comprising:

a receiving member having a press plate with an aperture therethrough;

a guide rod assembly pivotally coupled to the receiving member;

an actuating member pivotally coupled to the receiving member, the guide rod assembly pivotally coupled to the actuating member, the actuating member operable to position the guide rod assembly within the receiving member, the actuating member operable to move the guide rod assembly toward the press plate of the receiving member;

a first resistive element coupled to the guide rod assembly and the actuating member; and a second resistive element coupled to the guide rod assembly and the receiving member, the first and second resistive elements allowing the guide rod assembly to enter the receiving member and move toward the press plate.

9. The primer removal tool of claim 8, wherein the first resistive element has more resistance to movement than the second resistive element.

10. The primer removal tool of claim 8, wherein the first and second resistive elements are springs.

11. A primer removal tool, comprising:

a receiving member having a press plate with an aperture therethrough;

a guide rod assembly pivotally coupled to the receiving member; and an actuating member pivotally coupled to the receiving member, the guide rod assembly pivotally coupled to the actuating member, the actuating member operable to position the guide rod assembly within the receiving member, the actuating member operable to move the guide rod assembly toward the press plate of the receiving member, wherein the guide rod assembly has a first pivot tension with the receiving member and a second pivot tension with the actuating member.

12. The primer removal tool of claim 11, wherein the second pivot tension is higher than the first pivot tension.

13. A primer removal tool, comprising:

a receiving member with a press plate at a first end, the press plate having an aperture therethrough;

a guide rod assembly having a de-priming pin at a first end, the guide rod assembly having a second end pivotally connected to a second end of the receiving member;

a first spring connected between the receiving member and the guide rod assembly;

an actuating member having a first end pivotally connected to the second end of the guide rod assembly, the first end of the actuating member being pivotally connected to the second end of the receiving member; and a second spring connected between the actuating member and the guide rod assembly, the actuating member being operable to place the guide rod assembly within the receiving member against the first spring, the actuating member being operable to compress the second spring in order to move the guide rod assembly towards the press plate such that the de-priming pin extends into the aperture.

14. The primer removal tool of claim 13, wherein the second spring has a greater resistance to contraction than the first spring.

15. The primer removal tool of claim 13, wherein the guide rod assembly has a removable guide rod element, the removable guide rod element includes the de-priming pin and a sheath to surround a shell casing.

16. The primer removal tool of claim 13, wherein the guide rod assembly has a removable guide rod element, the removable guide rod element includes the de-priming pin and a structure such that a shell casing surrounds the guide rod assembly.

17. The primer removal tool of claim 13, further comprising:

a safety shield covering the aperture over the press plate, the safety shield operable to prevent an unspent primer from forcefully ejecting away from a shell casing.

* * * * *